US007428876B2

(12) United States Patent
Hillenbrand et al.

(10) Patent No.: US 7,428,876 B2
(45) Date of Patent: Sep. 30, 2008

(54) NEEDLE HOLDER FOR A SEWING MACHINE

(75) Inventors: Bernd Hillenbrand, Albstadt (DE); Bernd Binder, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/723,825

(22) Filed: Mar. 22, 2007

(65) Prior Publication Data

US 2007/0221110 A1 Sep. 27, 2007

(30) Foreign Application Priority Data

Mar. 22, 2006 (EP) ..... 06005802

(51) Int. Cl.
*D05B 55/02* (2006.01)
*D05B 55/00* (2006.01)

(52) U.S. Cl. ..... 112/226

(58) Field of Classification Search ..... 112/226, 112/225, 227, 192
See application file for complete search history.

(56) References Cited

U.S. PATENT DOCUMENTS

| | | | | | |
|---|---|---|---|---|---|
| 498,212 | A | * | 5/1893 | Laskey | 112/226 |
| 1,071,249 | A | * | 8/1913 | Martin | 112/226 |
| 1,075,743 | A | * | 10/1913 | Woodward | 112/226 |
| 1,286,410 | A | * | 12/1918 | Read | 112/270 |
| 1,605,385 | A | | 11/1926 | Bebel | |
| 3,713,407 | A | | 1/1973 | Ciecior | |
| 3,763,805 | A | | 10/1973 | Weigert | |
| 4,128,067 | A | | 12/1978 | Zocher | |
| 4,667,611 | A | * | 5/1987 | Yamamoto et al. | 112/166 |
| 5,555,831 | A | * | 9/1996 | Teeth et al. | 112/470.06 |

FOREIGN PATENT DOCUMENTS

| | | | |
|---|---|---|---|
| DE | 856 828 | | 11/1952 |
| DE | 872 147 | | 3/1953 |
| DE | 2732095 | C2 | 3/1988 |
| DE | 103 34 023 | A1 | 2/2005 |
| GB | 129 840 | A | 7/1919 |
| GB | 888 399 | A | 1/1962 |
| GB | 981 271 | A | 1/1965 |
| GB | 1 050 003 | | 12/1966 |

OTHER PUBLICATIONS

European International Communication and Search Report dated Aug. 8, 2007.

* cited by examiner

*Primary Examiner*—Ismael Izaguirre
(74) *Attorney, Agent, or Firm*—Norman N. Kunitz; Fitch, Even, Tabin & Flannery

(57) ABSTRACT

A needle holder (7) is provided, in particular, for industrial sewing machines, in which sewing machine needles having different needle gauges and preferably different cylindrical shanks or shafts are supported or held in such a manner that they can be adjusted in a transverse direction. This permits an adjustment of the relative position between the sewing needle (4) and the gripper (6), without requiring an adjustment of the gripper position and/or the needle guard position.

11 Claims, 8 Drawing Sheets

NEEDLE HOLDER FOR A SEWING MACHINE

CROSS REFERENCE TO RELATED APPLICATION

This application claims the priority of European Patent No. 06 005 802.1, filed on Mar. 22, 2006, the subject matter of which, in its entirety, is incorporated herein by reference.

BACKGROUND OF THE INVENTION

The invention relates to a needle holder for a sewing machine, in particular an industrial sewing machine. Referring to sewing machines, the needle holder, the stitch plate, the gripper and the needle guard must be positioned precisely relative to each other, in order to ensure reliable stitching, especially when sewing occurs at a high sewing speed and with a high number of stitches. If the adjustment of the position of the gripper relative to the needle is inadequate, faulty stitching, needle and thread breakage, as well as damage to the gripper and the needle guard may occur.

Referring in particular to the thickness of sewing needles, they are selected in view of the material that is to be sewn. Accordingly, there is the necessity for the use of sewing needles having different thicknesses on one and the same sewing machine.

In the vicinity of its eye, the sewing machine needle has a furrow, into which sinks the gripper while the stitch is being produced in order to pick up a thread that has been pushed through the sewing material. Needles of different thicknesses have a furrow with different depths. The base or bottom of the furrow thus has a different position depending on the respectively different sewing needle that is used.

This is obvious from document DE 103 34 023 A1 that discloses systems for the manufacture of needles having different thicknesses. When using these sewing needles, the gripper position need not be adapted to the respectively used needle thickness. Referring to needles having a large needle diameter in the region of the furrow, the use of the teaching of DE 103 34 023 leads to a small needle cross-section, compared with the needle cross-section in the region of the needle shaft. This increases the susceptibility to breakage, in particular in the case of needles having a large needle diameter (Nm).

Referring to home sewing machines, needles have a shank with a flat area to avoid a gripper adjustment. Referring to sewing machine needles having different gauges (needles with different nominal diameters), this flat area has a respectively different size in order to ensure that a gripper adjustment is not required when needles of different thicknesses are to be used. Referring to industrial sewing machines, however, as a rule, needles having a cylindrical shank are required. Consequently, the needle holder uniformly defines the central axis of all the sewing needles.

The adjustment of a gripper to adapt it to sewing needles of different gauges, as a rule, involves a significant amount of work and, in addition, requires a skilled operator. In particular, referring to lockstitch machines having a vertically arranged gripper axis, the subsequent adjustment of the gripper and the needle guard is particularly complex, thus resulting in down times and a significant setup effort.

DE Patent 872 147 discloses a sewing machine with a needle bar that can be shifted vertically in slide bearings. At its lower end, the needle bar supports a needle holder with a clamp screw for attaching a sewing needle. The slide bearings for the shiftable support of the needle bar are provided on a guide element which can be brought into the desired spatial position by means of adjusting screws, thus allowing an adjustment of the needle. Any subsequent adjustment of the needle, however, requires skilled knowledge and access to the interior of the sewing machine housing.

Referring to DE Patent 856 828 and U.S. Pat. No. 3,713,407, each discloses a sewing machine comprising a needle bar being provided on its lower end with a pocket bore that receives the shank of a sewing needle. Transversely to the pocket bore is a threaded bore for the accommodation of a clamp screw. Thus, the position of the sewing needle relative to the needle bar is defined.

GB Patent 1050003 discloses a sewing machine comprising a needle bar supported in an adjustable guide. The connection between the needle bar and the sewing needle is achieved simply by a conventional clamp screw. The adjustment of the needle bar guide requires access to the interior of the sewing machine and skilled knowledge.

Considering this, it is the object of the invention to provide an option that allows the use of needles of different gauges on sewing machines, in particular industrial sewing machines, without requiring a subsequent adjustment of the gripper.

SUMMARY OF THE INVENTION

The above object is achieved with the needle holder in accordance with Claim 1:

The needle holder comprises a holding device for the accommodation of a sewing needle in order to hold said needle in a holding position. The holding device has an adjustment device that can be adjusted in a direction transverse to the sewing needle and thus also transverse to the needle bar. In so doing, it can be ensured that needles of different thicknesses are respectively positioned in such a manner that the bottom of the needle furrow is located in one and the same relative position with respect to the gripper that interacts with the sewing needle. As a rule, the adjustment of the needle position is significantly easier than the adjustment of the gripper position. The needle is positioned, readily accessible, above the sewing machine table. Therefore, the adjustment of the needle position is easily achieved, for example, when the needle is changed.

As a result of the transverse adjustment of the needles, this adjustment does not have a defined zero position. Therefore, it is potentially possible to use stitch plates having different stitch hole positions. However, a stitch plate change is easily accomplished even by less skilled operators.

Also, sewing machines are known, in which case the needle sinks into a bore that is contained in the means that ensure the transport of the sewing material. These sewing machines do not comprise a stitch hole plate. The bore has a configuration that makes an adaptation of the position due to a needle change unnecessary.

Referring to the inventive needle holder, the sewing machine needle may be arranged in a shiftable manner relative to the actual needle bar, on which the sewing needle is held and which is moved vertically up and down during the sewing operation, so that the needle can be moved toward the gripper or away from the gripper. In so doing, the gripper position can remain unchanged.

Referring to a first embodiment, the adjustment device may comprise a clamping device, with which the shank of the sewing needle is tensioned relative to an abutment means with adjustable positions. A positional adjustment of the abutment means can be achieved, for example, in steps or continuously, in order to clamp the sewing needle in place in its respectively desired position. The adjustment device comprises an adjustable element, whereby the sewing needle abuts against said element (in which case the element represents an abutment means) or whereby said element holds the sewing needle (in which case the element represents a holding means). Also, the element may be designed as an interchangeable shim. All of the mentioned alternatives are suitable to implement the present invention.

Considering the ideal situation, a continuous positional adjustment is possible in order to adjust the optimal needle-to-gripper distance for any needle gauge. However, in many cases needles having a pre-specified gauge are used anyhow. In those cases, it is sufficient when the needle holder permits adjustment positions for needles having the corresponding needle gauge. Furthermore, it is possible to restrict the adjustment options to steps of, for example, 0.1 mm to 0.2 mm. For example, a mechanical adjustment device having an engagement dimension that has a pre-specified size of 0.2 mm, for example, may be provided. The needles may be divided into several groups, for example, four groups. Group 1 may include needles having a diameter Nm of 80,90,100. Group 2 includes needles having a diameter Nm of 110, 120, 130. Group 3 includes needles of Nm 140, 150, 160. Group 4 includes needles of Nm 180, 190, 200, for example. A mechanical adjustment in four positions can cover each essential needle gauge of groups 1 through 4, whereby each adjustment position is assigned to respectively one of the groups. Consequently, this takes into account any accuracy requirements that occur in the majority of practical applications.

Referring to a currently preferred embodiment, the adjustment device is an eccentric adjustment device. This device comprises, e.g., two cams which are supported so as to be rotatable about rotary axes extending longitudinally to the needle bar. In addition, the eccentric adjustment device is preferably combined with a linear guide device that pre-specifies a guide direction extending transversely to the needle bar. As a result of the interaction of the eccentric adjustment device and the linear guide device, a slim adjustment device is created, said device having an exterior contour that does not project beyond the exterior contour of the needle holder. Consequently, collisions between the adjustment device and other elements of the sewing machine are largely prevented. It is easily possible to integrate the adjustment device in existing machine designs.

It is possible to manually perform the adjustment. Appropriate manual adjustment devices preferably are stepped adjustment devices. Thus, erroneous adjustments are easily prevented. The operator only needs to select the correct engagement step or adjustment step. The adjustment may be achieved by means of a selector shaft, an incremental advance, a series connection or even with the use of appropriate shims. Likewise, it is possible to adjust the distance between the sewing needle and the gripper by electronic means, namely, by employing piezo technology, i.e., piezo drives or a servo motor. Electronic enabling or control is particularly advantageous because the desired machine settings can be maintained in a reproducible manner.

In the ideal case, each needle gauge is assigned to exactly one position of the sewing needle or of the adjustment device, which accomplishes that an optimal gripper distance is maintained. If an electronic control is used, a continuous adjustment option is advantageous.

Additional details of advantageous embodiments of the invention are obvious from the drawings, the description or the Claims.

The drawings show exemplary embodiments of the invention.

DETAILED DESCRIPTION OF THE INVENTION

Figure 1:
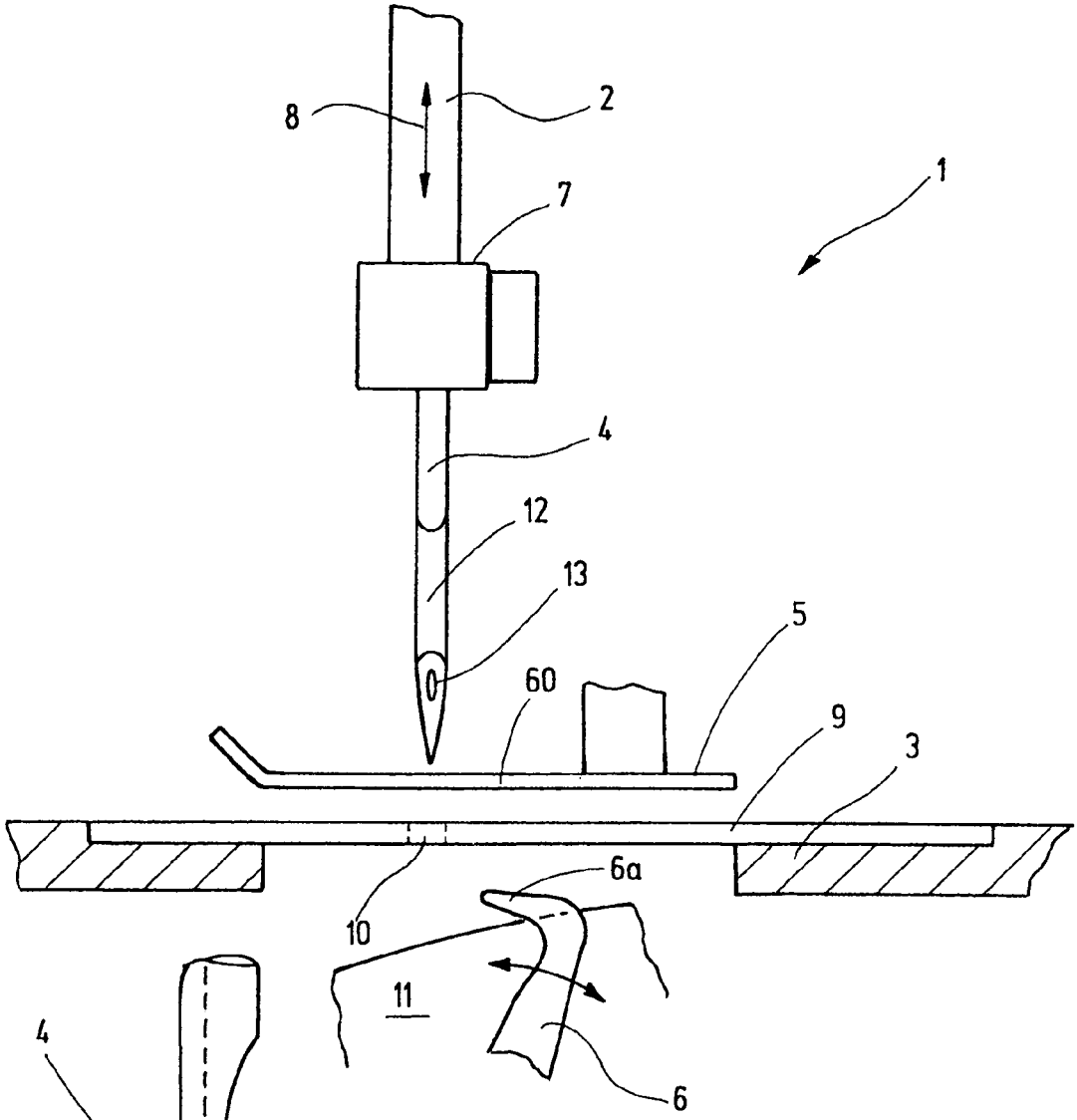
FIG. 1 is a schematic view of a section of a sewing machine.

FIG. 1 is a schematic illustration of a section of a sewing machine 1 comprising a needle bar 2 of a table 3 belonging to the sewing machine 1, a sewing needle 4, a foot 5 and a gripper 6. The illustrated gripper 6 is an alternating gripper 6 having a horizontal axis of rotation. The depiction of an alternating gripper 6 has been chosen as an example; whereby the same also applies to rotating grippers. The sewing needle 4 is attached to the needle bar 2 by means of a needle holder 7. The needle bar 2 is connected to a drive device and can be driven in a back-and-forth moving manner as schematically illustrated by an arrow 8 in FIG. 1. In so doing, it performs a linear motion along the longitudinal direction of the sewing needle 4. In other words, the sewing needle 4 is aligned parallel to the needle bar 2 and its direction of movement. The sewing needle 4 has, on its upper end, a cylindrical section, which is referred to as the shank and is used to attach the sewing needle 4. The shank is arranged concentric to the remainder of the sewing needle 4 and has a diameter that corresponds to that of the sewing needle 4 that is being used. All the sewing needles 4, which are assigned to a sewing machine and its needle bar 2, have the same shank diameter, regardless of their gauge.

The foot has a slit 60 that can be penetrated by the sewing needle 4. The material transporting means below the foot 5 are not shown. Furthermore, a stitch hole plate 9 is located under the foot 5, said plate having an opening 10 that is penetrated by the sewing needle 4. Located below the stitch hole plate 9 are the movable gripper 6 with a tip 6*a* and a needle guard 11, against which may abut the flank of the needle tip when the needle 4 moves in the region of its lower point of return. This results in a stabilization of the transverse movement of the sewing needle 4. The transverse movement of the sewing needle 4, which is actually undesirable, is a function of the sewing conditions, i.e., the sewing process. If the sewing needle does not perform any transverse movements or if such movements are equalized by the needle guard 11, it is easier for the gripper 6 to grip the thread. In so doing, the gripper 6 enters into the furrow 12 provided on the sewing needle 4 in order to grip a thread moving through the needle's eye 13.

Figure 1A:
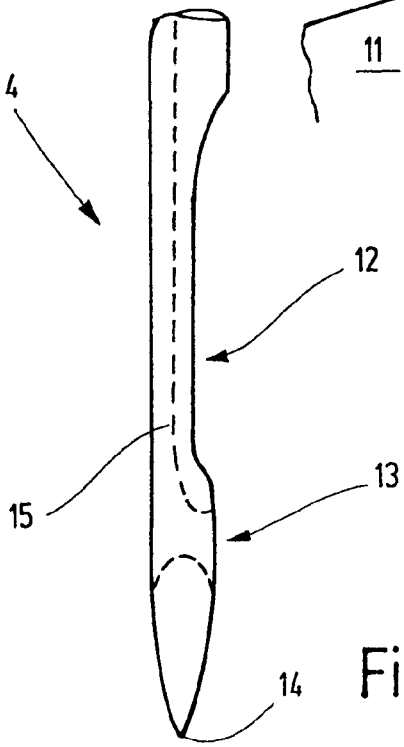
FIG. 1*a* is a sectional view, on a different scale, of a sewing needle of the sewing machine in accordance with FIG. 1.

FIG. 1*a* shows the sewing needle 4 by itself. They eye 13 is adjacent to the needle's tip 14. A needle slot 15 or thread groove terminates in the eye 13. The needle furrow 12 is located on the side opposite said needle slot. The sewing needle 4 and the gripper 6 are moved relative to each other so that the tip 6*a* of the gripper 6 sinks into the furrow 12 and, in so doing, does not, or only with minimal pressure, come into contact with said furrow.

Figure 2:
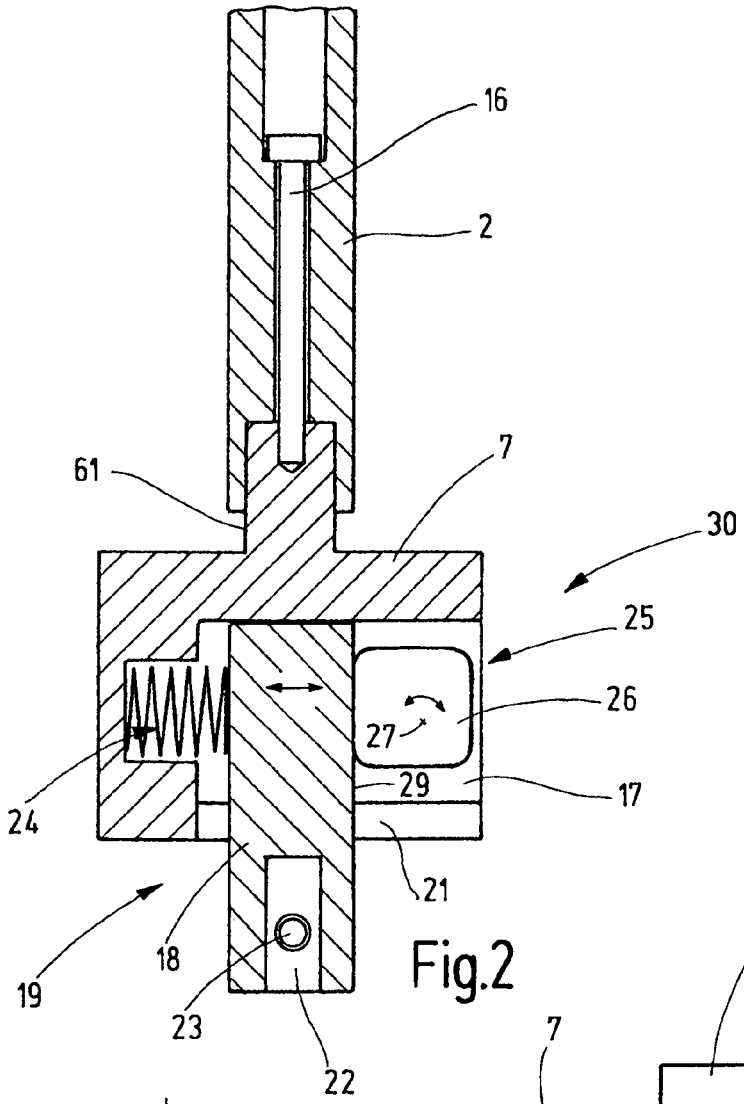
FIG. 2 is a schematic view, vertically in section, of a needle bar with needle holder and selector shaft for the adjustment of the needle position.

The needle holder 7 permits the attachment of sewing needles having different thicknesses and a uniform cylindrical shank, and permits their positioning on the needle bar 2, so that, despite the different needle thicknesses, the bottoms of the furrows 12 of needles having different gauges are in a uniform position relative to the gripper 6. FIG. 2 is a vertical sectional view of the needle holder 7 by itself. The needle holder represents, e.g., a housing having the configuration of a parallel epiped having on its upper side an extension with a threaded pocket bore. The extension 61 can be accommodated by a one-sided stepped bore that is provided in the needle bar 2. A screw 16 is used to fasten the needle bar 2 and the needle holder 7 to each other.

Figure 3:
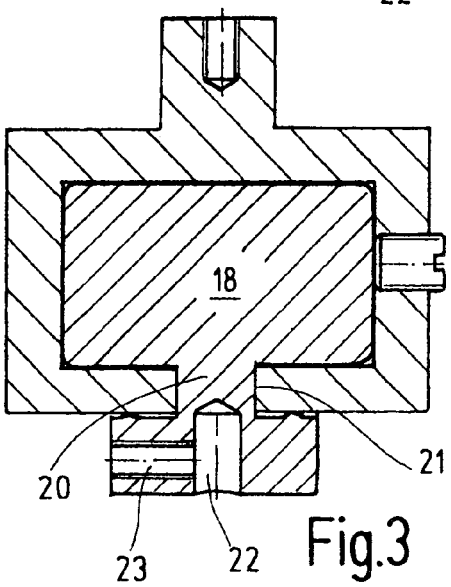
FIG. 3 is another view, vertically in section, of the needle holder in accordance with FIG. 2, whereby the plane of section is at a 90 degree angle with respect to the plane of section in accordance with FIG. 2.

The needle holder 7 encloses an interior space 17, in which a sliding element 18 is supported in such a manner that it can be adjusted in a direction transverse to the longitudinal direction of the needle bar 2, as well as in a direction transverse to the longitudinal direction of the sewing needle 4. In FIG. 2, the adjustment direction is indicated by an arrow. The sliding element 18 forms a support device 19 for the sewing needle 4. As shown by FIG. 3, said sliding element has a strip 20 that extends through a slit 21 provided on the underside of the needle holder 7. The end projecting from the needle holder 7 is a pocket bore 22 for the accommodation of the shank of the sewing needle 4. One or more threaded bores 23 intersecting these pocket bores 22 in transverse direction are disposed to accommodate clamp screws for locking the sewing needle 4 in place.

Figure 4:
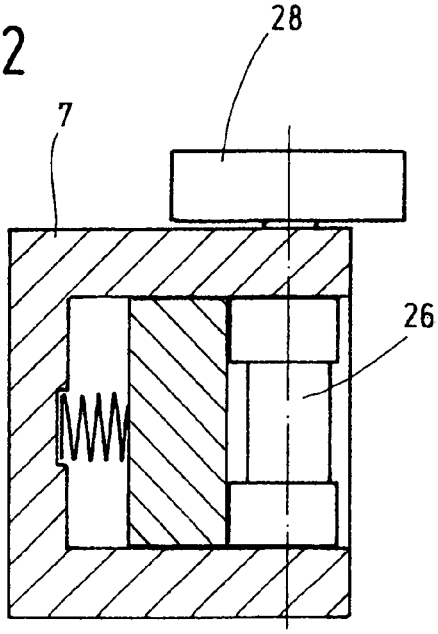
FIG. 4 is an illustration, horizontally in section, of the needle holder in accordance with FIGS. 2 and 3.

The sliding element 18 is pre-tensioned in an adjustment device by means of a tensioning means, for example having the configuration of a spring means, in particular having the configuration of a compression spring 24, and is pressed against an abutment means 25. In this embodiment, this abutment means is a selector shaft 26 which has two or more, e.g., four, engagement positions that are appropriately defined by flat lateral surfaces. The distances of these lateral surfaces from an axis of rotation 27 are different. The selector shaft 26 is arranged transversely to the needle bar 2 and the sewing needle 4, and one end of said shaft projects from the needle holder 7. As shown by FIG. 4, a means, for example, having the design of a selector wheel 28 may be provided on this end. The essentially flat lateral surfaces of the selector shaft 26 are parallel to the axis of rotation 27, which, in turn, is parallel to a flat lateral surface 29 of the sliding element 18.

The compression spring 24, or any other suitable tensioning means, and the abutment means 25 form an adjustment device 30 for the adjustment of the transverse position of the sliding element 18 relative to the longitudinal axis of the needle bar 2 and, in so doing an adjustment for the sewing needle 4. The operation of the adjustment device 30 is as follows:

For example, it is assumed that the four essentially flat lateral surfaces of the selector shaft 26 having approximately the shape of a parallel epiped are arranged at distances from the axis of rotation 27, said distances respectively differing from each other by 0.2 mm. As shown by FIG. 2, these differences are represented in a highly exaggerated manner. The needle holder 7, for example, acts to support and hold sewing needles having a diameter Nm of 80 to a diameter Nm of 200. For example, the needles Nm 80 to Nm 100 belong to a first group, those from Nm 110 to Nm 130 to a second group, those from Nm 140 to Nm 160 to a third group, and those from Nm 18 to Nm 200 to a fourth group. The operator selects an appropriate sewing needle from one of the four groups and sets the engagement position of the selector shaft 26 accordingly. The position of the selector shaft with respect to the four groups of needles may be selected, for example, by means of marks provided on the outside of the needle holder 2 or on the selector wheel 28. Once the adjustment has been made, the sewing needle is clamped in the pocket bore 22. If necessary, the stitch hole plate 9 can be adapted or exchanged. A gripper adjustment is not necessary. Consequently, after changing the needle and adjusting the adjustment device 30, the sewing operation can be begun.

Figure 5:
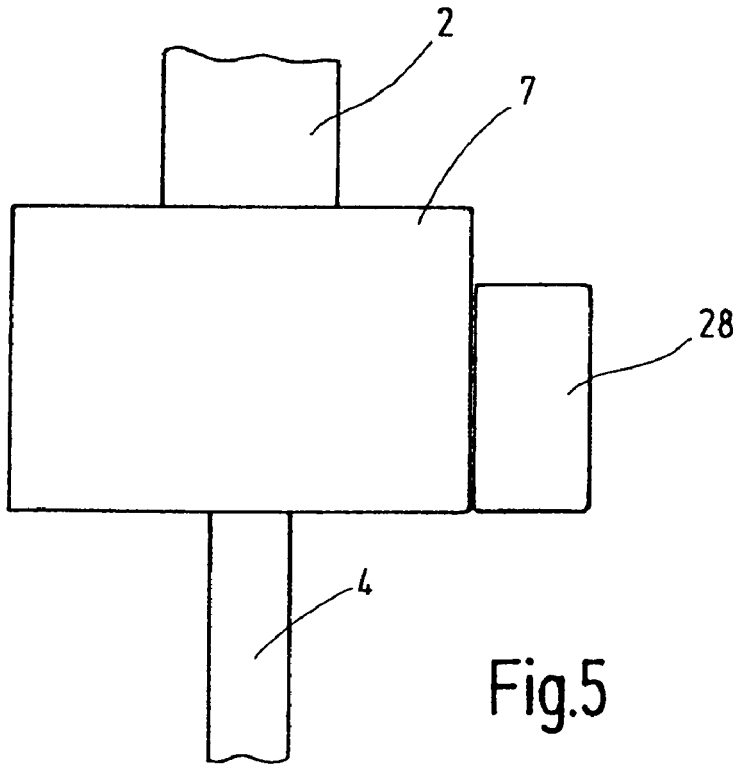
FIG. 5 is a modified embodiment of the needle holder for the sewing machine in accordance with FIG. 1.
Figure 6:
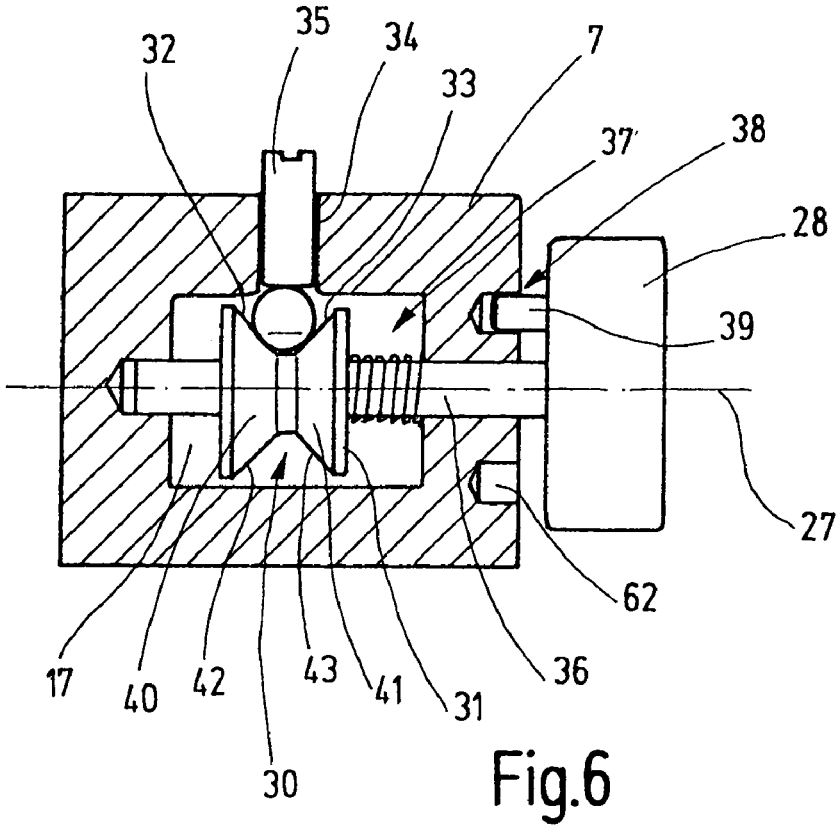
FIG. 6 is an illustration, horizontally in section, of the needle holder in accordance with FIG. 5.

FIGS. 5 and 6 show a modified embodiment of the needle holder 7, in which the adjustment device 30 does not require a support device 19. This will be explained hereinafter, whereby additional reference is made to the description above, this being applicable provided the same reference numbers are used and nothing to the contrary is stated.

A rotatably supported receiving prism 31 is supported inside the interior space 17 of the needle holder 7. On its circumference, said prism has three, four, or more cutouts that are bordered by preferably flat abutment surfaces 32, 33, against which abuts one end of the sewing needle 4, said end extending through a bore into the interior space 17. The abutment surfaces 32, 33 are oriented at a right angle with respect to each other, for example. Opposite the abutment surfaces 32, 33, the housing of the needle holder 7 has a threaded bore 34, in which a clamp screw 35 is seated. This screw is disposed to clamp the shaft or shank of the sewing needle 4 against the abutment means, i.e., the prism 31.

The prism 31 is supported, so that it can be rotated about the axis of rotation 27, by means of a shaft 36 in the needle holder 7, said axis of rotation extending transversely to the sewing needle 4, whereby the end of said needle projects from the needle holder 7 and supports the selector wheel 28. In addition, the shaft 36 can be adjusted in longitudinal direction against the force of a spring 37 or any other suitable tensioning means. The prism 31 of the shaft 36, or the selector wheel 28, can additionally be associated with an engagement device 38, which, in the simplest case—as illustrated—consists of an engagement pin 39, to which are assigned different engagement holes 62 located around the shaft 36.

Referring to the present exemplary embodiment, the prism 31 has four pairs of abutment surfaces. Referring to FIG. 6, the shaft of the sewing needle 4 abuts against the abutment surfaces 32, 33. Additional pairs of abutment surfaces are formed by the abutment surfaces, e.g., 40, 41, or 42, 43.

Considering this, FIG. 6 shows only three pairs of abutment surfaces. The exemplary embodiment, in fact, has four such pairs of abutment surfaces. The respective pairs of abutment surfaces define different abutment positions for the shaft of the sewing needle 4, in that said abutment surfaces are differently positioned with respect to the axis of rotation 27.

If the needle gauge is to be changed, the clamp screw 35 is first released and the sewing needle 4 removed. Then, the selector wheel 28 is turned by being drawn in axial direction in order to thus move the pin 39 out of its bore. As soon as the pin has been released, the selector wheel 28 can be rotated into the desired engagement position, which now corresponds to the needle gauge to be used. If the selector wheel 28 is released, the spring 37 pushes the shaft 36 back into its home position, whereby the pin 39 moves into an appropriate different bore 62.

Considering the new engagement position, a different pair of abutment surfaces has arrived at the position facing the clamp screw 35. Now, the sewing needle 4 having the desired needle gauge is inserted in the intermediate space between the respective abutment surfaces and the clamp screw 35, and the clamp screw 35 is tightened. Now the sewing operation can be started or continued.

Figure 7:
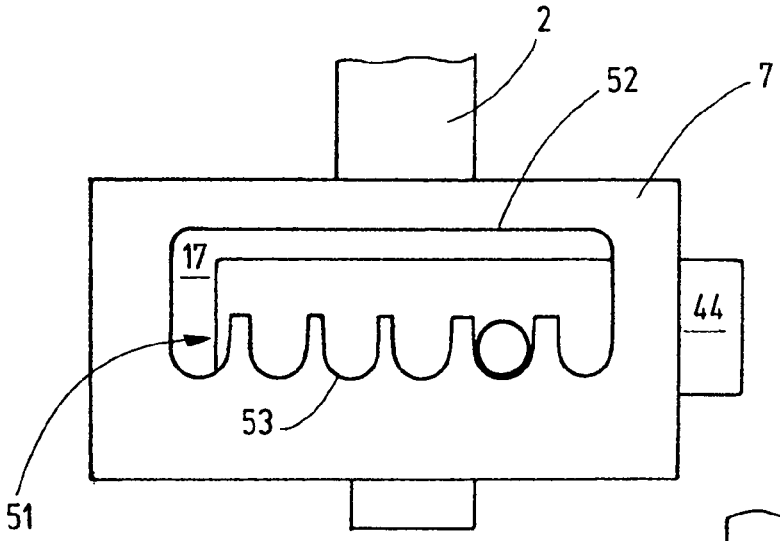
FIG. 7 is a schematic side view of another modified embodiment of the needle holder for a sewing machine in accordance with FIG. 1.
Figure 8:
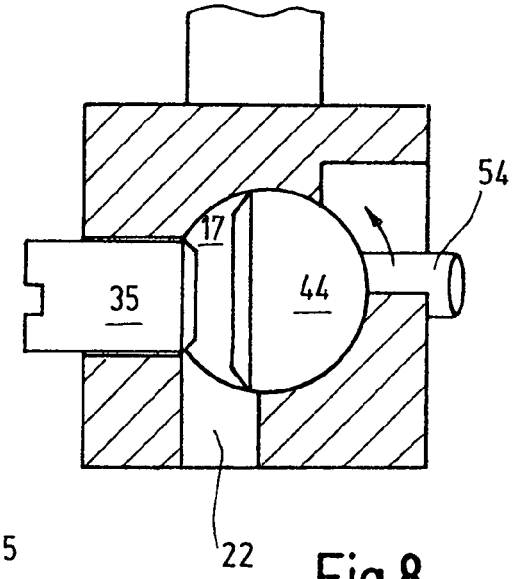
FIG. 8 is a front view of the needle holder in accordance with FIG. 7.
Figure 9:
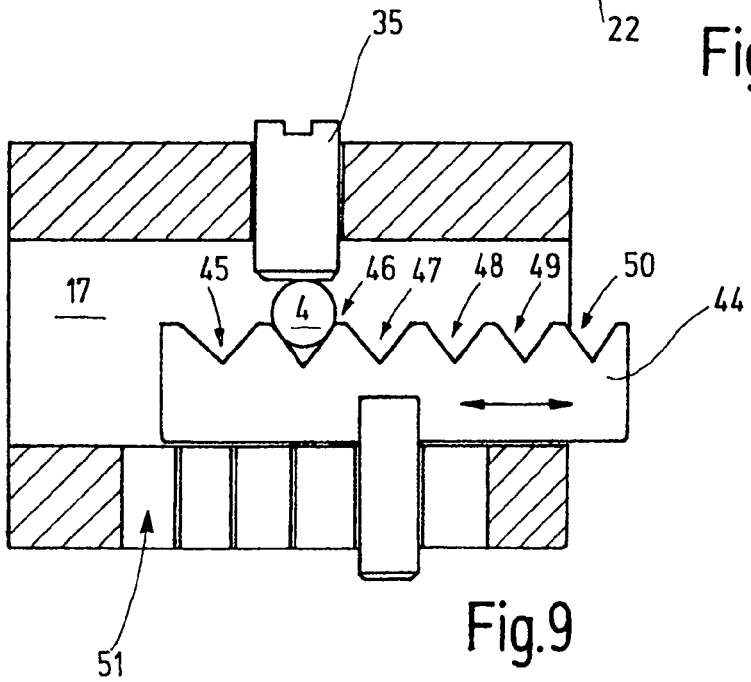
FIG. 9 is a horizontal section of the needle holder in accordance with FIG. 7.

FIGS. 7 through 9 show another exemplary embodiment which has more additional engagement positions. With the exception of the special features explained hereinafter, the description of the Figures above is applicable to the embodiment in accordance with FIGS. 7 through 9, while the same reference numbers are being used.

The interior space 17 of the needle holder 7 has an engagement insert 44, which has, on one side facing the clamp screw 35, a row of prism-like seats 45, 46, 47, 48, 49, 50. They are not exactly identical but are configured in such a manner that they define, for the sewing machine needle, transverse positions with respect to the needle bar 2, said positions respectively differing by a desired value. Other than that, the slide 44 has a cylindrical shape in order to fit into the likewise approximately cylindrical bore of the interior space 17.

On the side of the needle holder 7 opposite the clamp screw 35, said needle holder is provided with a window 51, which, as shown by FIG. 7, has an essentially straight edge 52, and on the opposite side, a toothed edge 53. The toothed edge 53 consists of a row of approximately semi-circular cutouts, in which is seated a dog 54 extending away from the rear side of the slide 44. This dog can be pivoted out of a corresponding space between teeth in the direction shown by the arrow in FIG. 8, whereby the slide 44 pivots about its longitudinal axis. The dog 54 projecting from the needle holder 7 can be used as a means to move the slide 44 in the desired axial positions. Once an appropriate axial position has been selected, a sewing needle 4 can be pushed through the opening 22 into the appropriately selected seat 45 through 50 and be tightened in place by means of the clamp screw 35 on the slide 44.

Figure 10:
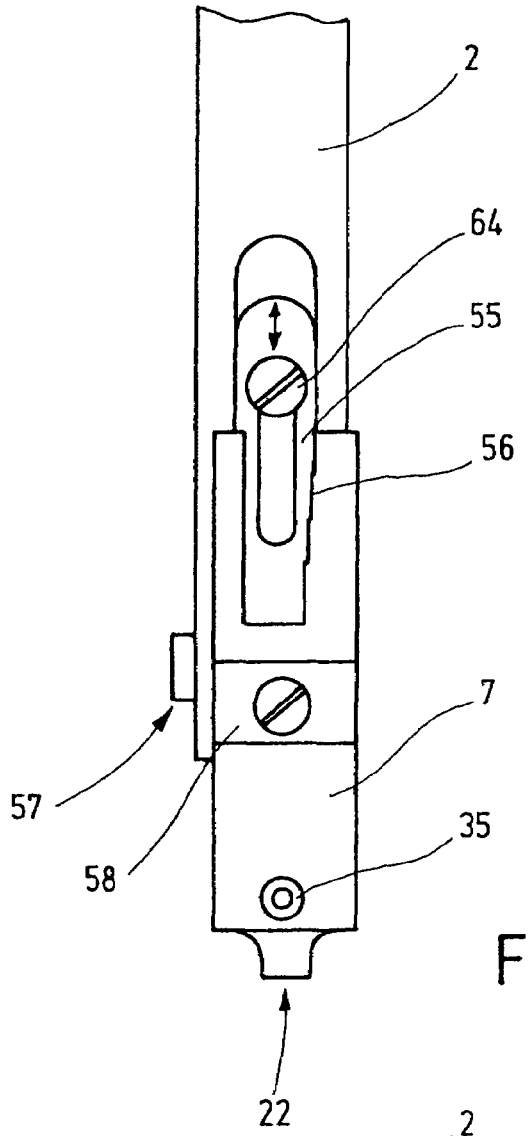
FIG. 10 is a modified embodiment of the needle holder for a sewing machine in accordance with FIG. 1.

FIG. 10 shows an additional embodiment of the invention, in which the needle holder 7 can be adjusted on the needle bar 2 by means of a slide 55. The latter is in contact with a staggered lateral surface 56 of a cutout of the slide 7, which is supported in a transversely adjustable manner on the needle bar 2. Each step of the lateral surface 56 is associated with a group of needles. The exemplary embodiment in accordance with FIG. 10 shows four steps. If a more precise adjustment or positioning of the needle 4 with respect to the needle bar 2 is desired, several steps may be provided. Appropriate screws 57, 58, 64 are used to clamp the needle holder in place in its respectively adopted shifting positions. The advantage of this embodiment is in its slim configuration and its low weight. If a continuous adjustment is to be allowed, the lateral surface 56 can be configured as a wedge-shaped surface. The manual adjustment, however, will then be slightly more complex. For example, such an adjustment can be achieved with the use of orientation marks.

Figure 11:
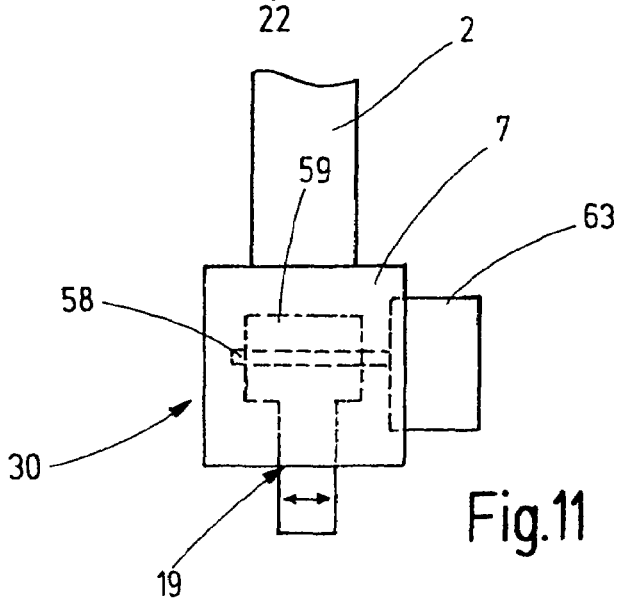
FIG. 11 is a schematic side view of another modified embodiment of the needle holder for the sewing machine in accordance with FIG. 1.

FIG. 11 shows another embodiment of the invention, to which applies the above description with the exception of the special features described hereinafter.

The support device 19 that accommodates the sewing needle is provided in or on the needle holder 7. The support device 19 can be adjusted by means of an electrically operated actuating drive 63. This drive can be, for example, an electric motor, a piezo drive or the like. It effects the desired adjustment of the support device 19 via a transmission. For example, the transmission may consist of a threaded spindle 58 and of a spindle nut 59 driven by said spindle, said spindle nut being connected to the support device 19. One or more position sensors may be provided, said sensors detecting the rotary position of the actuating drive 63 of the linear position of the spindle nut 59. This allows the remote-controlled, preferably continuous, adjustment of the position of the longitudinal axis of the sewing needle 4 relative to the longitudinal axis of the needle bar 2.

Figure 12:
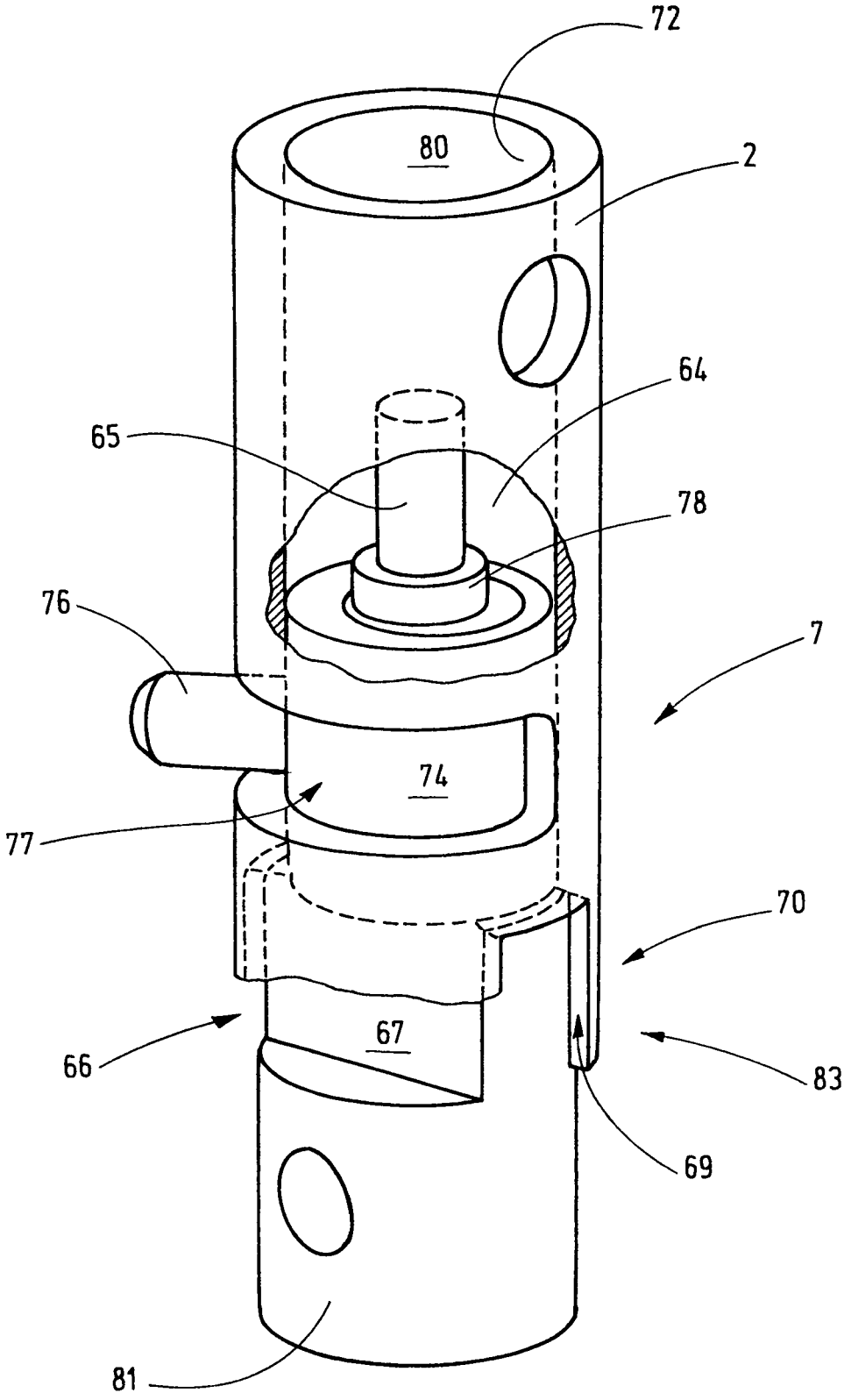
FIG. 12 is a perspective view (diagonally from the bottom) of another modified embodiment of the needle holder for the sewing machine in accordance with FIG. 1.
Figure 13:
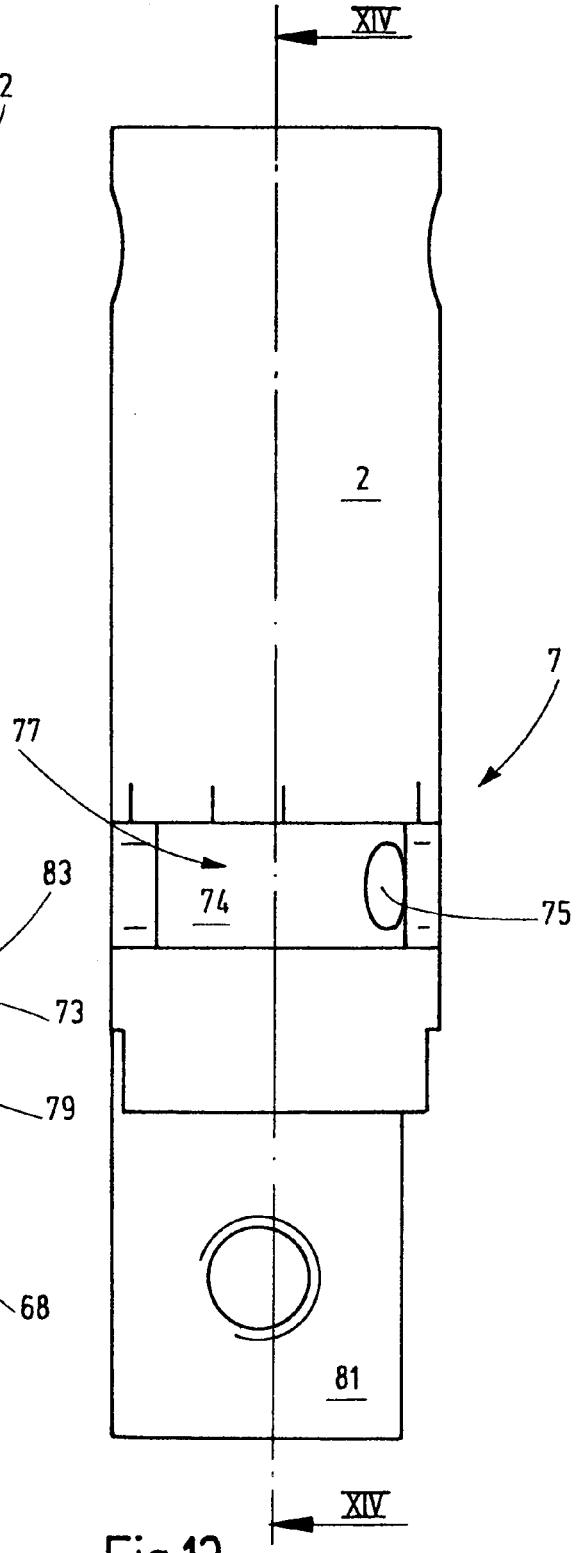
FIG. 13 is a schematic side view of the needle holder in accordance with FIG. 12.

FIG. 2 shows a modified embodiment of an adjustment device for the adjustment of the needle position, said device being operational between the needle bar 2 and the needle holder 7. Referring to FIG. 12, the needle bar 2 may also be an adapter 2 that is installed on a needle bar 2 of a sewing machine 1. The adjustment device is an eccentric adjustment device 64 that is located on the lower end of the needle bar 2 and is received by a bore 80 of the needle bar 2. As is obvious from FIGS. 12, 13 and, in particular, from FIG. 14, the eccentric adjustment device 64 has a needle receiving element 81 with an axially aligned extension 65 having a diameter that is significantly smaller than the diameter of the needle bar 2 or its bore 80. The needle bar or the adapter 2 has, on its lower end, a slit 69, in which a guide section 66 of the needle receiving element 81 is retained in a movable manner. The guide section 66 has two parallel flat flanks 67, 68. A slit 69 of the needle bar 2 extends over the guide section 66, exhibiting minimal play. In so doing, the slit 69, together with the guide section 66, forms a linear guide device 70 that is designed as a lateral guide, i.e., it defines a guide direction transverse to the longitudinal direction of the needle bar 2. The longitudinal direction coincides with the direction of movement of the needle bar 2 and is marked by an arrow 71 in FIG. 14.

Figure 15:
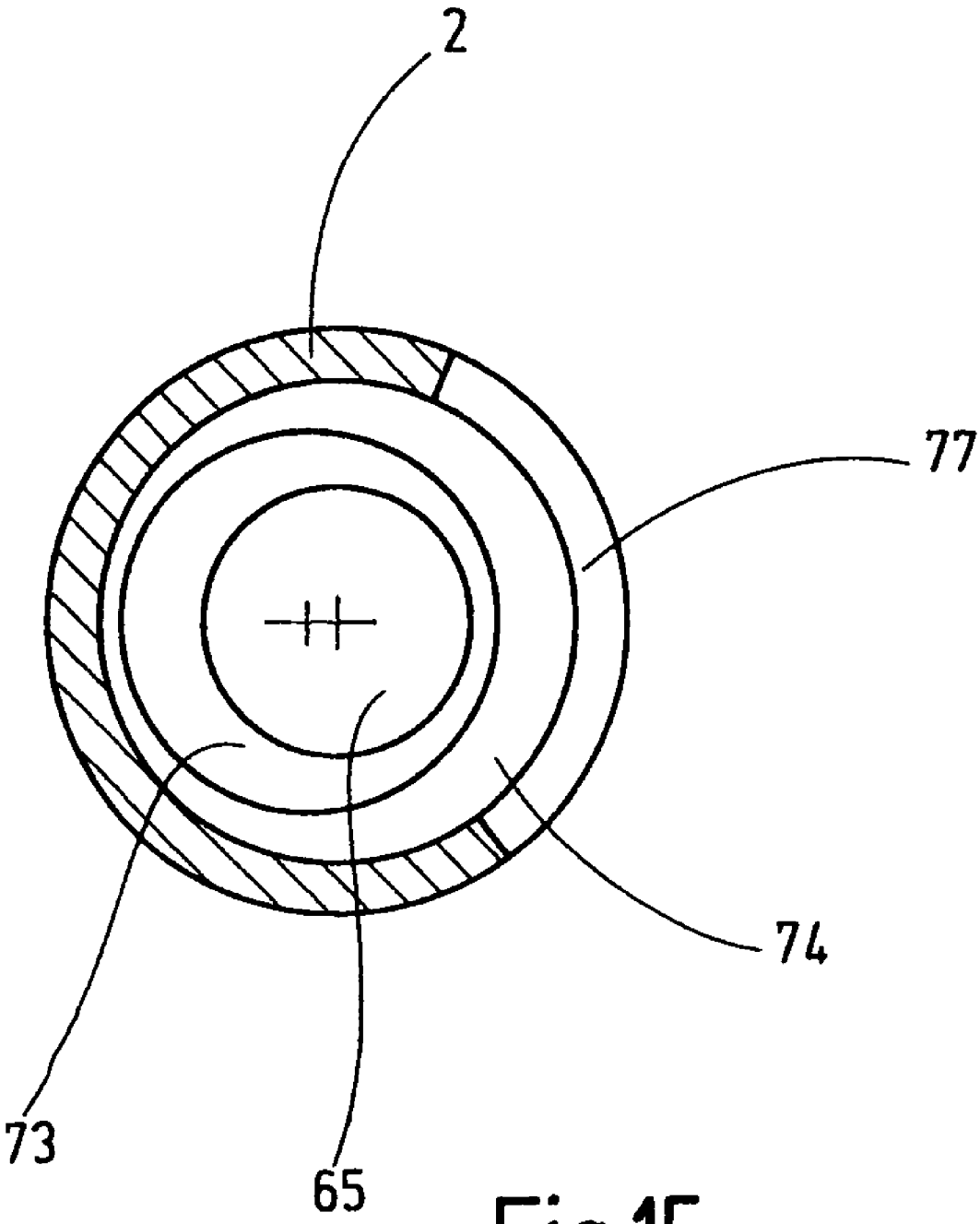
FIG. 15 is a schematic view, from the bottom, of the needle holder in accordance with FIG. 12.

The needle bar 2 has an interior space 80 which is limited by a cylindrical wall 72. The interior space or bore 80 is arranged eccentrically (not illustrated) relative to the longitudinal axis of the needle bar 2. Thus, the wall 72 has, on its circumference a continuously changing gauge or thickness. The extension 65 extends into the interior space 80. Seated on the extension 65 is a cam 73, which has a cylindrical eccentric bore. The cam 73 is rotatably supported on the extension 65, exhibiting minimal play. The center axis of its cylindrical generated surface is aligned parallel to the center axis of the extension 65. This is obvious from FIG. 15, in particular.

Figure 14:
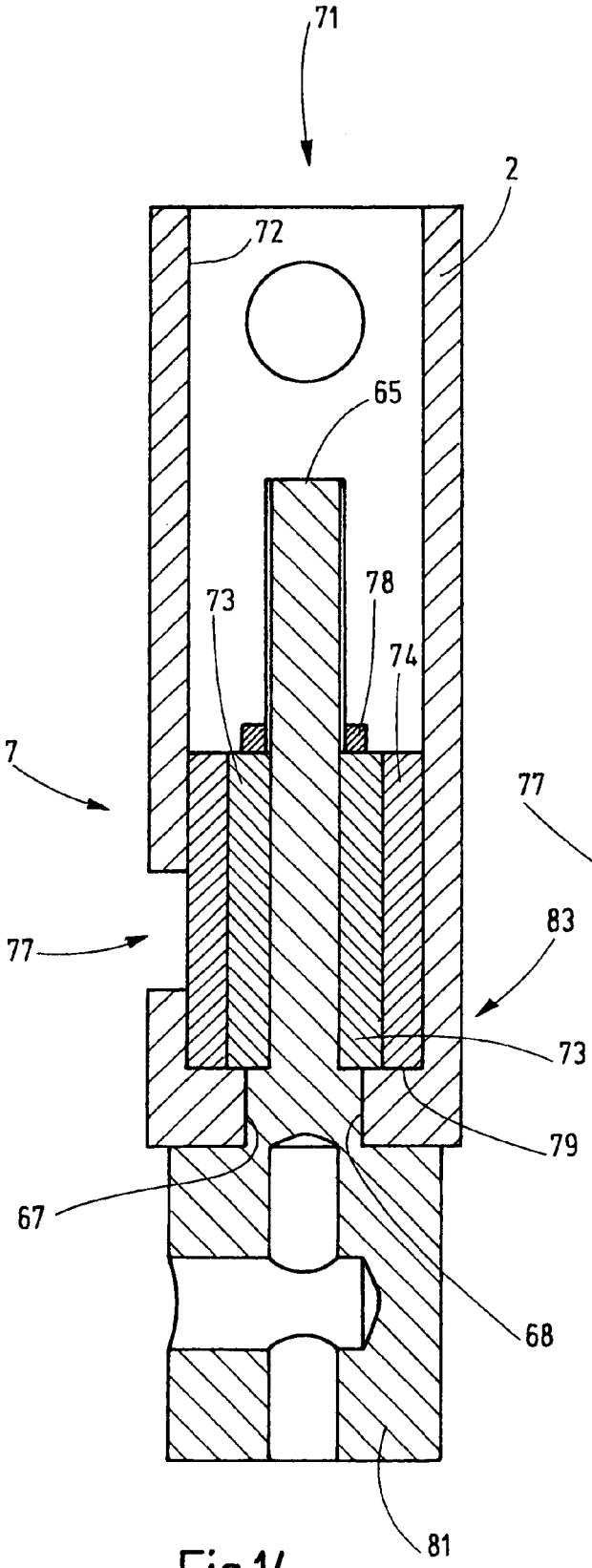
FIG. 14 is a schematic view, vertically in section, of the needle holder in accordance with FIG. 12.

As shown by FIG. 14, another cam 74 is seated on the cam 73. This cam 74 has a cylindrical bore that is seated, with minimal play, on the cylindrical generated surface of the first cam 73 and can be rotated relative thereto. The cam 74 has a cylindrical exterior generated surface that is arranged eccentric to its central through bore. The exterior cylindrical generated surface of the second cam 74 abuts, with minimal play, against the wall 72 of the needle bar 2.

The second cam 74 has a radial bore 75 into which an adjustment means may be inserted or, as shown by FIG. 12, a pin 76 may be permanently inserted. This pin extends through a slit 77 provided in the needle bar 2, said slit extending in circumferential direction at a pre-specified angle, for example 130° or 180°.

So it cannot be lost, the eccentric adjustment device 64 is secured on the needle bar 2 in axial direction. To achieve this, a retaining means, e.g., designed as a ring 78,seated on the extension 65 can be used. The bore 80 of the needle bar 2 has, on its end 83, a step configured as an inward directed shoulder 79. Both cams the interior cam 73 and the exterior cam 74 abut rotatably against the shoulder 79. So that it may not be lost, the cam 73 is tensioned between the shoulder 79 and the retaining means 78, in that the retaining means 78 is mounted with a chucking device, e.g., a screw, to the extension 65. As a result of this, the needle receiving element 81 is held on the needle bar 2 to prevent said needle receiving element from becoming lost. Access to the chucking device occurs through the bore 80. In axial direction, the exterior cam 74 is held in place by the pin 76.

The operation of the eccentric adjustment device 64 described so far is as follows:

An adjustment of the needle holder 7 or the needle receiving element 81 relative to the needle bar 2 can take place only in the guide direction defined by the linear guide device 70. For adjustment, the exterior cam 74 is turned about the longitudinal axis of the needle bar 2 due to said cam's action on pin 76. The rotation of the cam 74 results in the enforced (e.g., counter-directional) rotation of the cam 73. This is because, as a result of the linear guide device 70, the axis of rotation of the cam 74 can move only on a linear path. The axis of rotation coincides with the center axis of said cam's exterior generated surface. As opposed to this, the interior cam 73 can only rotate about the extension 65. In this instance, the axis of rotation coincides with the axis of symmetry of its interior generated surface, i.e., its bore wall. Accordingly, the axis of the eccentric bore of the exterior cam 74 moves on an arcuate path. The path of the generated surface of the interior cam 73 is the same, thereby enforcing, for example, a counter-directional rotation of the two cams 73, 74. The rotation of the exterior cam 74 results in a yielding motion of the interior cam 73, said motion being a corresponding rotary motion. The superimposition of the two rotary motions of the two cams 73, 74 produces a combined movement enforced by the guide device 70.

Following the adjustment of the needle holder 7, the newly adjusted position is secured by a locking means (not illustrated). This locking means may be designed, e.g., as a known screw. To do so, the lower end 83 of the needle bar 2 or of the adapter 2 has a threaded bore. In order to fix the position of the needle holding element 71, the fixing means is installed in the screw thread, in which case the end of the screw presses against the flank 67 or 68 and thus clamps the guide section of the needle holding element 7 in place. Thus, the newly adjusted position of the needle holder 7 is fixed by a non-positive connection.

The inventive needle holder 7 is provided, in particular, for industrial sewing machines, in which sewing machine needles having different needle gauges and preferably different cylindrical shanks or shafts are supported or held in such a manner that they can be adjusted in transverse direction. This permits an adjustment of the relative position between the sewing needle 4, or the bottom of the furrow 12 of the sewing needle 4, and the gripper 6, without requiring an adjustment of the gripper position and/or the needle guard position.

It will be appreciated that the above description of the present invention is susceptible to various modifications, changes and adaptations, and the same are intended to be comprehended within the meaning and range of equivalents of the appended claims.

LIST OF REFERENCE NUMBERS

1 Sewing machine
2 Needle bar, adapter
3 Table
4 Sewing needle
5 Foot
6 Gripper
6*a* Gripper tip
7 Needle holder
8 Arrow
9 Stitch hole plate
10 Opening
11 Needle guard
12 Needle furrow
13 Eye
14 Tip
15 Needle slot, thread groove
16 Screw
17 Interior space
18 Sliding elements
19 Support device
20 Strip
21 Slit
22 Pocket bore, opening
23 Threaded bore
24 Compression spring
25 Abutment means
26 Selector shaft
27 Axis of rotation
28 Selector wheel
29 Lateral surface
30 Adjustment device
31 Prism, abutment means
32, 33 Abutment surfaces
34 Threaded bore
35 Clamp screw
36 Shaft
37 Spring
38 Engagement device
39 Pin
40, 41, 42, 43 Abutment surfaces
44 Slide
45, 46, 47, 48, 49, 50 Seats
51 Window
52 Edge
53 Edge
54 Dog
55 Slide
56 Lateral surface
57, 58, 64 Screws
58 Threaded spindle
59 Spindle nut
60 Slit
61 Extension
62 Engagement hole
63 Actuating drive
64 Eccentric adjustment device
65 Extension
66 Guide section
67 Flank
68 Flank
69 Slit

70 Linear guide device
71 Longitudinal direction
72 Wall
73 Cam
74 Cam
75 Radial bore
76 Pin
77 Slit
78 Ring, retaining means
79 Shoulder
80 Bore, interior space
81 Needle receiving element
83 End

The invention claimed is:

1. Needle holder for a sewing machine whereby the needle holder is set up to receive a sewing needle in order to firmly hold said sewing needle on a needle bar in a holding position, comprising an adjustment device provided on the needle holder for the adjustment of the holding position of the needle holder in a direction transverse to the longitudinal direction of the sewing needle, wherein the adjustment device is an eccentric adjustment device having a first cam that is rotatably supported about an axis that extends longitudinally to the needle bar, and a guide device is located between the needle bar and the needle holder, with the guide device being a linear guide having a guide direction extending in a direction transverse to the longitudinal direction of the needle bar.

2. Needle holder in accordance with claim 1 wherein the adjustment device is set up for the adjustment of the relative position of the sewing needle with respect to a needle guard and/or with respect to a gripper, which belongs to the sewing machine and which is used for gripping the thread guided by the sewing needle.

3. Needle holder in accordance with claim 1 wherein the adjustment device is designed so as to define several needle holding positions, in which the sewing needle is respectively held parallel to a needle movement direction that is defined by the sewing movement of the sewing needle.

4. Needle holder in accordance with claim 1, wherein the adjustment device is designed for manual adjustment.

5. Needle holder in accordance with claim 1, wherein the adjustment device is set up for a continuous position adjustment.

6. Needle holder for a sewing machine whereby the needle holder is set up to receive a sewing needle in order to firmly hold said sewing needle on a needle bar in a holding position, comprising an adjustment device provided on the needle holder for the adjustment of the holding position of the needle holder in a direction transverse to the longitudinal direction of the sewing needle, wherein the adjustment device is an eccentric adjustment device having a first cam that is rotatably supported about an axis that extends longitudinally to the needle bar, and the eccentric adjustment device has a second cam that is rotatably supported.

7. Needle holder in accordance with claim 6, wherein the first cam and the second cam are force-coupled such that they rotate in the same direction or in opposite directions.

8. Needle holder in accordance with claim 7, wherein a guide device is located between the needle bar and the needle holder.

9. Needle holder in accordance with claim 6, wherein a guide device is located between the needle bar and the needle holder.

10. Needle holder for a sewing machine whereby the needle holder is set up to receive a sewing needle in order to firmly hold said sewing needle on a needle bar in a holding position, comprising an adjustment device provided on the needle holder for the adjustment of the holding position of the needle holder in a direction transverse to the longitudinal direction of the sewing needle, wherein the adjustment device is an eccentric adjustment device having a first cam that is rotatably supported about an axis that extends longitudinally to the needle bar, a guide device is located between the needle bar and the needle holder, the needle bar has a slit, and the needle holder has a needle receiving element with a guide section, whereby the guide section and the slit make up the guide device.

11. Needle holder for a sewing machine whereby the needle holder is set up to receive a sewing needle in order to firmly hold said sewing needle on a needle bar in a holding position, comprising an adjustment device provided on the needle holder for the adjustment of the holding position of the needle holder in a direction transverse to the longitudinal direction of the sewing needle, wherein the adjustment device is an eccentric adjustment device having a first cam that is rotatably supported about an axis that extends longitudinally to the needle bar, and includes an actuating drive that is a drive which can be electrically controlled and/or regulated.

* * * * *